US005242116A

United States Patent [19]

Bonezzi

[11] Patent Number: 5,242,116

[45] Date of Patent: Sep. 7, 1993

[54] EJECTION NOZZLE DEVICE FOR HIGH PRESSURE CLEANING APPARATUS

[75] Inventor: Gabriele Bonezzi, Reggio Emilia, Italy

[73] Assignee: Faip S.r.l. Officine Meccaniche, Variano Cremasco (Cr.), Italy

[21] Appl. No.: 829,958

[22] Filed: Feb. 3, 1992

[30] Foreign Application Priority Data

Feb. 11, 1991 [IT] Italy ..... MI91000337

[51] Int. Cl.[5] ..... B05B 1/16

[52] U.S. Cl. ..... 239/438; 239/443

[58] Field of Search ..... 239/436, 437, 438, 440, 239/441, 443, 447, 448, 449

[56] References Cited

U.S. PATENT DOCUMENTS

| | | | |
|---|---|---|---|
| 576,259 | 2/1987 | Diamond | 239/438 |
| 3,117,726 | 1/1964 | Schoberg | 239/443 |
| 3,514,042 | 5/1970 | Freed | 239/441 |
| 4,095,747 | 6/1978 | Anderson | 239/443 |
| 4,265,405 | 5/1981 | Takagi | 239/440 |
| 4,785,998 | 11/1988 | Takagi | 239/440 |
| 4,886,213 | 12/1989 | Kristensen | 239/458 |

FOREIGN PATENT DOCUMENTS

| | | | |
|---|---|---|---|
| 277067 | 5/1913 | Fed. Rep. of Germany | 239/438 |

*Primary Examiner*—Andres Kashnikow
*Assistant Examiner*—Christopher G. Trainor
*Attorney, Agent, or Firm*—Bucknam and Archer

[57] ABSTRACT

An ejection nozzle for high pressure and low pressure cleaning apparatus having a cylindrical hollow body (14) with a front flange (31) having a central inwardly projecting cavity (33) and provided with a central narrow orifice (32), and at least two annular orifices (34), a distributing valve (20) with a central duct (26) sealingly slidable in the cavity of the cylindrical body (14) and having an external front portion (20') mating the central cavity (33), an exterior coaxial cylindrical shell (10) consisting of a front portion (12) fixed to the cylindrical body (14), and a rear portion (12') slidable on the body (14), and a device for placing the front portion (20') in sealingly engagement with the central cavity (33) in the high pressure ejection and out of the cavity (33) in the low pressure ejection.

12 Claims, 1 Drawing Sheet

EJECTION NOZZLE DEVICE FOR HIGH PRESSURE CLEANING APPARATUS

TECHNICAL FIELD

The present invention relates to an ejection nozzle device for high-pressure cleaning units or other like apparatus.

DESCRIPTION OF THE RELATED ART

More particularly, the present invention relates to an ejection nozzle device for high-pressure cleaning apparatus with aligned delivery ducts. In fluid delivery devices, known by the term nozzles and coupled with the water cleaning machines, there is the requirement to obtain a variation in the pressure of the water at the outlet. Specifically there is the requirement to change readily from high pressure delivery to low pressure delivery and vice versa, without significant direct regulation of the device.

To obtain this result, some ejection nozzles are generally equipped with two independent different ejection nozzles, viz a narrow high-pressure nozzle and a large low-pressure nozzle. Frequently, the two nozzles are placed as separate units having separate inlet tubes from the operating valve. These devices require regulation or switching, which are very complicated and which therefore do not satisfy the requirement for rapid and immediate change of water pressure. Other nozzles are structured in such a manner as to present a single inlet duct. In this case the change from high pressure outlet to low pressure outlet is done in general by means of channels derived from the main supply duct and which force the fluid into articulated paths until they issue obligatorily through a single orifice.

U.S. Pat. No. 4,886,213 describes an ejection nozzle device provided with a single inlet tube in which the low-pressure and high-pressure ejection occur through the same actual nozzle opening.

The nozzle device known by the above U.S. patent comprises: an inlet duct having a terminating narrow opening for high pressure ejection; one or more side ducts branching out from sad inlet duct, said one or more side ducts terminating in an annular space around the high-pressure nozzle portion, this space being forwardly open or openable in an annular area through such a large opening area that low-pressure discharge of a spraying liquid can occur; and operating means for opening and closing this discharge through the one or more said ducts and the annular space, the operating means consisting of an axially slidable protruding cylinder jacket which is outside the annular area and has a shoulder face of sufficient area that, during high-pressure ejection, liquid pressure against said shoulder face is effective to maintain said cylinder jacket in position to close the one or more side ducts for low-pressure discharge and to maintain high-pressure ejection in the nozzle. This ejection nozzle device, however, has some drawbacks which limits its use in all the applications. One of the drawbacks is that the low-pressure and high-pressure discharge occurs through the same central nozzle opening which is essentially coaxial with the high-pressure nozzle portion. Therefore, the low-pressure ejected jet is concentrated and not open (rose shape). Furthermore the operating means are maintained in position to close the low-pressure discharge by the liquid pressure, no blocking means in the high and low pressure ejection is provided. A further drawback is that the high-pressure nozzle portion cannot be easily changed, especially during the operating phase.

SUMMARY OF THE INVENTION

The object of the present invention is to solve all the above drawbacks of the known ejection.

Particularly, the object of the present invention is to provide an ejection nozzle device especially adaptable to high-pressure water cleaning machines, which allows fast, effective change of water pressure at the outlet at high or low pressure with an effective stabilization of the nozzle assembly in the respective positions.

Another object of the invention is to provide an ejection nozzle device in which there are advantageously involved in the low pressure water outlet phase at least two delivery orifices in which the high pressure outlet orifice can be readily and rapidly replaced if necessary.

A further object of the invention is to provide a nozzle as defined above in which the passage of water through the body at high or low pressure follows essentially linear flow, consequently optimizing the delivery and substantially reducing the vibrations.

According to the present invention, these and other objects are achieved by an ejection nozzle device comprising: an ejection nozzle device for high-pressure cleaning apparatus, placed at the end of a water supply tube (24), comprising:

- a cylindrical hollow body having a front flange provided with a central, inwardly projecting cavity, having a trunco-conical longitudinal cross-section, a central narrow orifice and at least two opposite orifices on the annular portion of the front flange;
- a distributing valve having an axial central duct, connected to the end of the water supply tube, arranged in the cavity of the cylindrical hollow body and sealingly, axially slidable wit respect thereto; said distributing valve having, at its external side, a front portion with a small diameter and a trunco-conical longitudinal cross-section corresponding to and exactly mating the central cavity;
- an exterior coaxial cylindrical shell consisting of a front portion, sealingly fixed to the external surface of the cylindrical hollow body, and a rear portion slidable on the external surface of said cylindrical body; and
- means for blocking the front portion of the distributing valve either in sealingly engagement with the central cavity so that the annular orifices are closed and the water flows directly from the central duct of the distributing valve to the central narrow orifice, or out from the central cavity by forming a discharge chamber between the front portion and the front flange.

BRIEF DESCRIPTION OF THE DRAWINGS

The constructive and operating characteristics of the ejection nozzle device of the present invention will become clearer from the following detailed description taken with reference to the accompanying drawing which shows a preferred and not limitative embodiment of the present invention, and in which.

Figure 1:
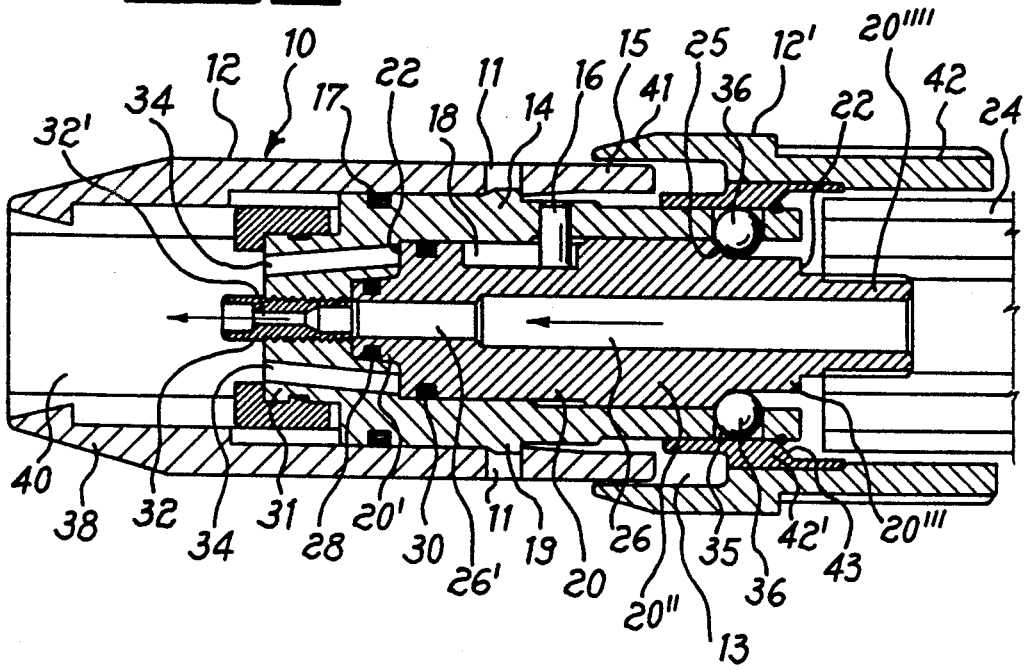
FIG. 1 is a longitudinal cross-section of the ejection nozzle device to the invention.

The ejection nozzle device is placed at the end of a water supply tube (24) issuing from a spray grip (not shown) connecting with the discharge hose from a high-pressure cleaning unit and provided with a valve for opening and closing the outflow from the tube (24).

The ejection nozzle device of the present invention consists of two coaxial main parts axially slidable in relation to one another: an inner part which is securely connected with the end of the tube (24) and an outer part axially slidable on the inner part.

The inner part is a distributing valve (20) having a central axial duct (26), having preferably a smaller diameter at its front end position (26'). At its external side, the distributing valve (20) has a front portion (20') having a smaller diameter, a trunco-conical longitudinal cross-section and a sealing ring (28) fitted in it; a middle portion (20'') with a sealing ring (30) fitted in it, and a rear portion (20''') having a smaller diameter than that of the middle portion (20'') and extending rearwardly in a smaller end portion (20 '''') consisting an adequate engagement and constraint seat for the supply tube (24). The front portion (20') is connected to the middle portion (20'') by a sharp step (22); while the rear portion (20''') is connected to the middle portion (20'') through a chamfered step (25).

The middle portion (20'') of the distributing valve (20) is provided on its external surface with a longitudinal seat (18).

The outer part of the nozzle device of the present invention consists of several jointed components which are axially slidable on the surface of the distributing valve (20). the exterior of the outer part is a coaxial cylindrical shell (10) consisting of two cylindrical portion; a front portion (12) and a rear portion (12'), partially telescopically slidable one on the other. For this purpose, the rear portion (12') is provided, at the front edge, with a slot (13) receiving the rear edge (15) of the front portion (120).

The front portion (12) has, in front, a constricted orifice cylindrical portion (38) with an external, wide ejection opening (40), permitting unobstructed ejection of the water.

The front portion (12) of the shell (10) has an annular groove (11). A cylindrical hollow body (14) is arranged within and fixed to the cavity of the front portion (12) and sealing ring (17), fitted on the external surface of the body, assures the sealing between the cylindrical body (14) and the front portion (12).

The cylindrical hollow body (14) has, in its external surface, an annular projection (19) engaged and fitted in the annular groove (11) of the front portion (12) and assuring the fixing between the body (14) and the front portion (12). The distributing valve (20) is slidably arranged within the cavity of the cylindrical hollow body (14); the outer surface of the middle portion (20'') sealingly engages the inner surface of the hollow body (14) by means of the sealing ring (30).

The cylindrical hollow body (14) has a front flange (31) provided with a central, inward-projecting cavity (33) having a trunco-conical, longitudinal cross-section, corresponding to and accurately mating and housing the front portion (20') of the distributing valve (20) when in the high pressure operating position shown in FIG. 1. The front portion (20') sealingly engages the surface of the central cavity (33) by means of the sealing ring (28). The central cavity (33) is provided with a central orifice (32) in front and coaxial with the central axial duct (26). This central orifice (32), which is intended to deliver the fluid, such as water, under high pressure, according to its preferred embodiment, has an intermediate neck (32') which allows to increase the pressure of the ejected fluid (water).

The annular portion of the front flange (31) is provided with at least two annular opposite orifices (34) which are intended to deliver the fluid (water) under low pressure. These orifices (34) are sloping and their longitudinal axis converge toward the axis of the central orifice (32), which corresponds to the symmetrical axis of the device. When the distributing valve (20) is in the high pressure operating position shown in FIG. 1, the annular orifices (34) are closed by the sharp step (22) connecting the front portion (20') to the middle portion (20'') of the distributing valve (20).

The cylindrical hollow body (14) has an inwardly projecting pin (16), slidably arranged in the longitudinal seat (18) of the distributing valve (20), and through the wall just before its free end, tow or more wide radial orifices (35) for acceptance of steel balls (36).

These balls (36) are in contact with and rotate on the outer surface of the distributing valve (20).

The rear portion (12') of the shell (10) consists of two sectors (41, 42), each having a different inner diameter, connected by a chamfered step (43). The first sector (41) in contact with the external surface of the cylindrical hollow body (14) and, therefore, has an inner diameter substantially equal to or slightly larger than the outer diameter of said cylindrical body (14); and a second sector (42) having a larger inner diameter so that it can embrace the water supply tube (24).

The first sector (41) is provided with the slot (13), at the front edge, receiving the rear edge (15) of the front portion (12) of the shell (10). The cylindrical hollow body (14) is non-rotatably secured to the distributing valve (20) by means of the inwardly projecting pin (16) and longitudinal seat (18) so that the entire outer part is axially slidable on the distributing valve (20).

Figure 2:
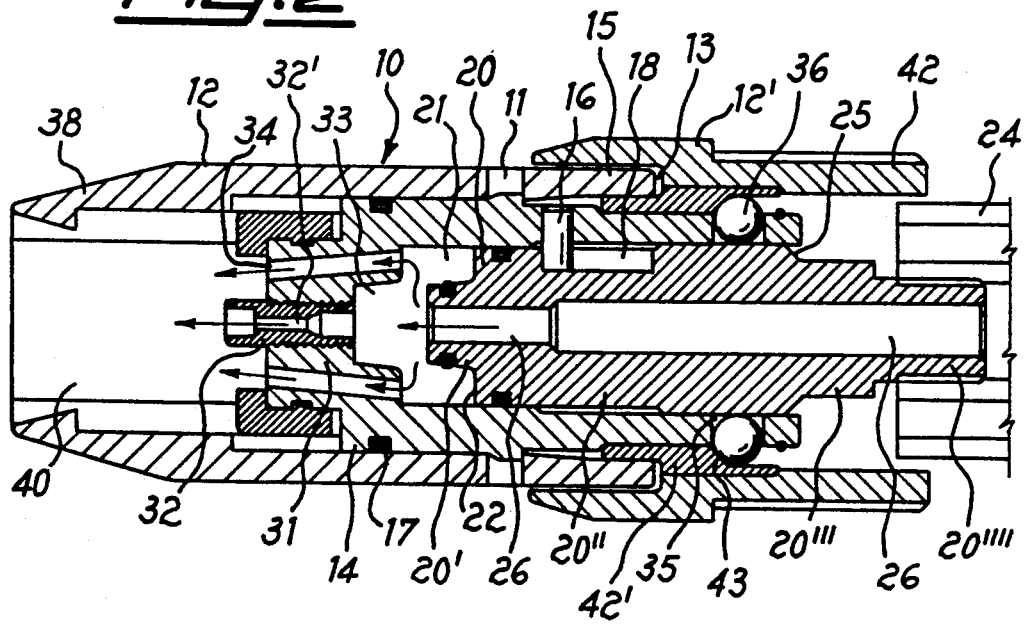
FIG. 2 is a corresponding view of the device of FIG. 1 shown in another operating position.

The operation of the ejection nozzle device of the present invention is as follows: when it is desired to work with low-pressure ejection, the front portion (12) of the cylindrical shell (10) should simply be pushed to its foremost position as shown in FIG. 2. In this position, the front portion (20') of the distributing valve (20) is brought out of sealing engagement with the central cavity (33) of the front flange (31) and in the rear with respect to the front flange (31). A discharge chamber (21) is thus formed between the front portion (20') and the front flange (31), and the annular orifices (34) are open.

Water, coming from the central duct (26), can flow forward through the central (32) and annular orifices (34) from the chamber (21). The total area of the annular orifices (34) is substantially greater than the area of the central orifice (32).

The water is ejected at low pressure through the wide opening (40). In the protruding position, the pin (16) meets the advanced shoulder face of the seat (18) so that the front portion (20') is stabilized.

The balls (36) are arranged between the inner surface of the larger sector (42) and the outer surface of the middle portion (20'') of the distributing valve (20), in contact with the chamfered step (43); and the rear edge (15) is inserted into the slot (13).

When it is desired to work with high-pressure ejection, the rear portion (12') of the cylindrical shell (10) should simply be pushed to its retracted position, as shown in FIG. 1.

The motion of the rear portion (12') involves also that of the cylindrical hollow body (14) in the same direction. This motion of the cylindrical body (14) is due to the pushing action of the chamfered step (43) on the steel balls (36) which, in their turn, draw the cylindrical body (14).

As the steel balls (36) reach the position corresponding to the rear portion (20'') of the distributing valve (20), they drop on the surface of this rear portion (20''') and are released from the engagement with the chamfered step (43). In this position, the pin (16) meets the retracted shoulder face of the seat (18); the trunco-colical front portion (20') of the distributing valve (20) is within the cavity (33) of the front flange (31), and the annular orifices (34) are closed by the sharp step (22). The sealing ring (28) assures the sealing of the front portion (20') into the cavity (33) and constitutes a block against the forward discharge of water. The balls (36) are between the surface of the rear portion (20''') of the distributing valve (20) and the surface of the first sector (41) and in contact with the chamfered step (25) of the distributing valve (20) and prevent any rearward motion of the distributing valve (20). In this way, the distributing valve (20) will be stabilized in a position in which the water flows directly from the central duct (26) to the narrow nozzle opening (32) and high-pressure ejection can be achieved.

The passage from high-pressure to low-pressure ejection is easily achieved by forwardly moving the rear portion (12') of the shell (10).

When the balls (36) are in the direction of the chamfered step (43), they are arranged in the larger section (42) and are released from the chamfered step (25). The cylindrical hollow body (14) is drawn by the ball (36), which slide on the surface of the distributing valve (20), to its foremost position shown in FIG. 2 and the chamber (21) is formed.

The components of the ejection nozzle device of the present invention can be made of rigid plastic material with a rough surface finish; however, it is preferred that the portion (42') of the sectors (41, 42) corresponding to the chamfered step (43), which in operation will be in contact with the steel balls (36), be made of a metal, such as aluminum or steel.

The ejection nozzle device of the present invention allows to achieve numerous advantages. In fact, it allows rapid and easy change of the water delivery conditions concerning the pressure and at the same time, offers precise assurance concerning positioning stability in the alternate positions of use. The arrangement of the annular orifices (34) involved during low pressure outlet as well as the whole structure which leads to delivery of water along flow lines which are essentially linear in all circumstances are particularly appreciable. The central orifice (32), due to its arrangement int he body of the front flange (31), is easy to replace without complicated operations.

Although the invention has been described in conjunction with specific embodyments, it is evident that many alternatives and variations will be apparent to those skilled in the art in light of the foregoing description. For example, there can be formed a plurality of orifices near to and around the central one (32) for high pressure flow and these orifices can be formed or shaped differently to appropriately convey or distribute the water flow. The balls (36) which constitute the stop and positioning members in the alternate phases of delivery can also be replaced by equivalent systems, optionally involving rotating movement of the external shell or shells for bayonet type locks and the like.

Accordingly, the invention is intended to embrace all of the alternatives and variations that fall within the spirit and scope of the appended claims.

I claim:

1. A nozzle device for a cleaning apparatus capable of operating at high pressure and low pressure discharge positions, said nozzle device being placed at the end of a water supply tube (24), said nozzle device comprising:

an exterior cylindrical shell (10) consisting of a front portion (12) and a rear portion (12');

a cylindrical hollow body (14) located within said cylindrical shell (10), and coaxially thereto; said cylindrical hollow body having an external surface, said front portion (12) of said cylindrical shell (10) being sealingly fixed to said external surface of said cylindrical hollow body (14), said rear portion (12') being slidable on said external surface of said cylindrical body (14);

said cylindrical hollow body (14) having a front flange (31) provided with a central, inwardly projecting cavity (33), said cavity having a trunco-conical longitudinal cross-section and a central narrow orifice (32), said front flange having an annular portion, and at least two opposite orifices (34) on said annular portion of said front flange (31), a distributing valve (20) having an axial central duct (26) connected to the end of the water supply tube (24), said valve being located in said cylindrical hollow body (14) and being sealingly, axially slidable therein; said distributing valve (20) having a front portion (20') a middle portion (20''), a rear portion (20''') and an end portion (20''''), said front portion having a trunco-conical longitudinal cross-section of smaller diameter corresponding to and exactly mating said central cavity (33);

means for holding said front portion (20') of said distributing valve (20) in sealingly engagement with said central cavity (33) whereby the two opposite orifices (34) are closed and the water flows at high pressure directly from said central duct (26) of the distributing valve (20) to the central narrow orifice (32), and means for releasing said front portion (20') of said distributing from said central cavity (33) whereby a discharge chamber (21) is formed between said front portion (20') of said distributing and said front flange (31) and water is ejected at low pressure from said two opposite orifices (34).

2. The nozzle device according to claim 1, wherein a first sealing ring (28) is fitted about said front portion (20') of said distributing valve; a second sealing ring (30) is fitted about said middle portion (20'') of said distributing valve; said rear portion (20''') has a smaller diameter than the diameter of the middle portion (20''); said middle portion (20'') being connected to the front portion (20') of said distributing valve by a sharp step (22) and to the rear portion (20''') of said distributing valve by a first chamfered step (25).

3. The nozzle device according to claim 2, wherein said rear portion (20''') of said distributing valve extends rearwardly to said end portion (20'''') said end portion having a smaller diameter than said rear portion of said distributing valve for engagement with said supply tube (24).

4. The ejection nozzle device according to claim 1 wherein said middle portion (20'') of said distributing valve (20) has an external surface, and said external surface has a longitudinal seat (18) and said cylindrical hollow body (14) has an inwardly projecting pin (16) slidably arranged in said longitudinal seat (18).

5. The nozzle device according to claim 1, wherein said rear portion (12') of said shell (10) is provided, at its front edge, with a slot (13), said front portion (12) of said distributing valve having a rear edge (15), ad said rear edge being partially telescopically slidable within said slot (13).

6. The nozzle device according to claim 1, wherein said front portion (12) of said shell (10) has an annular groove (11) and the cylindrical hollow body (14) has, on said external surface, an annular projection (19) engaged in said annular groove; and sealing ring (17).

7. The nozzle device according to claim 1, wherein said central orifice (32) is in front and coaxial with said central axial duct (26) and is provided with an intermediate neck (32') for increasing the pressure of the ejected water.

8. The nozzle device according to claim 2, wherein sad cylindrical hollow body (14) has an end opposite to said front flange and a wall and through the wall just upstream of said end, two or more wide radial orifices (35), and steel balls (36) adapted to be received in said radial orifices are provided, said distributing valve (20) having an outer surface, sad balls being in contact with and rotating on said outer surface.

9. The nozzle device according to claim 8, wherein said rear portion (12') of said shell (10) comprises a first sector (41) in contact with said external surface of said cylindrical body (14), said cylindrical body (14) having an outer diameter, said first section (41) having an inner diameter equal to or slightly larger than said outer diameter of said body (14), and a second section (42) having a larger inner diameter than said first sector to embrace the water supply tube (24); said first (41) and second (42) sectors being connected by a second chamfered step (43).

10. The nozzle device according to claim 9, wherein a portion (42') of said first and second sectors (41, 42) are made of a metal.

11. The nozzle device according to claim 9, wherein in said high-pressure discharge ejection position, said steel balls (36) are between the surface of said rear portion (20''') of said distributing valve (20) and the surface of said first sector (41) and in contact with said first chamfered step (25); and, at said low-pressure ejection position, said steel balls (36) are between the surface of said middle portion (20'') of said distributing valve (20) and the surface of the second sector (42) and in contact with said second chamfered step (43).

12. The nozzle device according to claim 1, wherein said central orifice (32) has an axis and said two opposite orifices (34) are sloping and the longitudinal axis thereof converges toward said axis of said central orifice (32).

* * * * *